114-253. OR 3,949,698 SR

T114/253

United Sta
Sell

[11] 3,949,698
[45] Apr. 13, 1976

[54] ADJUSTABLE SKI HITCH

[76] Inventor: James F. Sell, R.R. 3, Box 157, Muncie, Ind. 47302

[22] Filed: Oct. 9, 1974

[21] Appl. No.: 513,267

[52] U.S. Cl. ..... 114/235 WS
[51] Int. Cl.[2] ..... B63B 21/56
[58] Field of Search..... 114/235 WS, 218; 115/6.1

[56] References Cited

UNITED STATES PATENTS

| | | | |
|---|---|---|---|
| 3,034,470 | 5/1962 | Vanderfeltz et al. | 114/235 WS |
| 3,110,331 | 11/1963 | Buchanan | 114/235 WS |
| 3,233,934 | 2/1966 | Osborn et al. | 114/218 X |

*Primary Examiner*—Trygve M. Blix
*Assistant Examiner*—Gregory W. O'Connor
*Attorney, Agent, or Firm*—Albert L. Jeffers; Roger M. Rickert

[57] ABSTRACT

An accessory for attachment to the transom of a power boat for providing a relatively high easy release tow rope attachment point above the general level of the boat stern is disclosed comprising a plurality of telescopingly engaged tubular members having at least a pair of elbow portions in L-shaped tubular members with tow rope attachment device such as a ring and stud located on a tubular member between the elbow portion and having means associated with adjacent pairs of telescoping tubular members for fastening those pairs together. Two of the fasteners also function to attach the accessory to the boat transom and the telescoping overlaps may be provided with a plurality of alignable apertures thus allowing the height and width of the accessory to be adjustably determined for a particular installation.

4 Claims, 6 Drawing Figures

ADJUSTABLE SKI HITCH

BACKGROUND OF THE INVENTION

The present invention relates to a device for attaching a tow rope to a water craft, and more particularly for attaching such a tow rope to a power boat for towing water skiers and the like.

In recent years water skiing has become a particularly popular sport and typically skiers are towed by attaching a tow rope to a so-called bow-eye typically found on the stern of the boat and used for removing the craft from the water by hoist as well as for mooring purposes. Such attachment points are low and near the water line and become even lower when the high powered boats are in a planing attitude. Desirably the direction of pull for the skiers should be somewhat upwardly relative to the water line and one known attempt to provide a high rope attachment point has been to employ a large horizontal bar supported by a pair of vertical members extending upwardly from a mounting arrangement built into the floor and frame of the craft, thus taking up valuable floor space and obstructing rearward vision. An installation of this type of course requires a different mounting arrangement for different makes and models.

Improved tow rope attachment schemes are found in my copending United States patent application Ser. No. 434,854 filed Jan. 21, 1974 now U.S. Pat. No. 3,890,918, which provide a desirable tow rope attachment point for inboard or inboard-outboard power boats but which may experience mounting difficulties on some types of outboard power boats since the motor may interfere with a central mounting of the ski bar requiring that it be mounted in an offset manner which again may lead to problems, for example, when a skier is offset from the towing craft in the opposite direction. Other attempts to provide a ski-tow hitch applicable to outboard craft are represented by U.S. Pat. No. Des. 187,057 issued Jan. 12, 1960 and U.S. Pat. No. 3,084,470 issued May 15, 1962. These further prior art approaches are severely limited in their applicability to a wide variety of differently configured boats and are commercially available in various sizes to make up for their lack of universal applicability.

It is, therefore, one object of the present invention to provide a tow rope attachment accessory of nearly universal applicability.

Another object of the present invention is to provide a relatively high easy release tow rope attachment point.

A further object of the present invention is to provide an adjustable ski hitch accommodating a wide variety of outboard motors and boats.

Still another object of the present invention is to provide a tow rope attachment accessory which avoids floor mounting problems yet provides the desirably high point of pull for water skiers.

A still further object of the present invention is to provide an adjustable ski hitch characterized by its economies of manufacture and installation.

SUMMARY OF THE INVENTION

The foregoing, as well as numerous other objects and advantages of the present invention, are achieved by providing a tow rope attachment accessory comprising a sleeve with a ring and adjacent stud attached thereto whereby a tow rope bight may be passed through the ring and over the stud with the ring preventing inadvertent detachment of the tow rope from the stud and having a pair of generally L-shaped structures telescopingly engaging the sleeve from opposite ends thereof with each L-shaped structure having adjustable means remote from the sleeve for attaching the L-shaped structures to the boat stern to thereby support the sleeve at a preferred height above the stern as determined by the selected position of the adjustable means. The adjustable means may include telescoping portions in the L-shaped structures remote from the sleeve, and means for simultaneously securing the telescoping portions together in a preferred position and securing the accessory to the transom of a power boat.

The subject matter which I regard as my invention is particularly pointed out and distinctly claimed in the concluding portion of this specification. My invention itself however, together with further objects and advantages thereof may best be understood by reference to the following description taken in conjunction with the accompanying drawings.

DESCRIPTION OF THE PREFERRED EMBODIMENT

Figure 1:
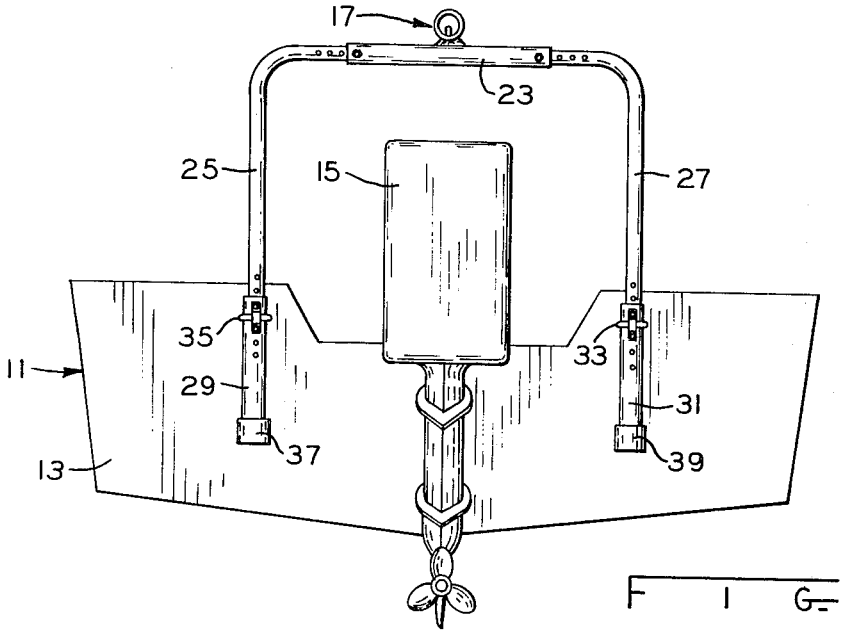
FIG. 1 is a stern view of an outboard powered boat with the accessory of the present invention in place.
Figure 2:
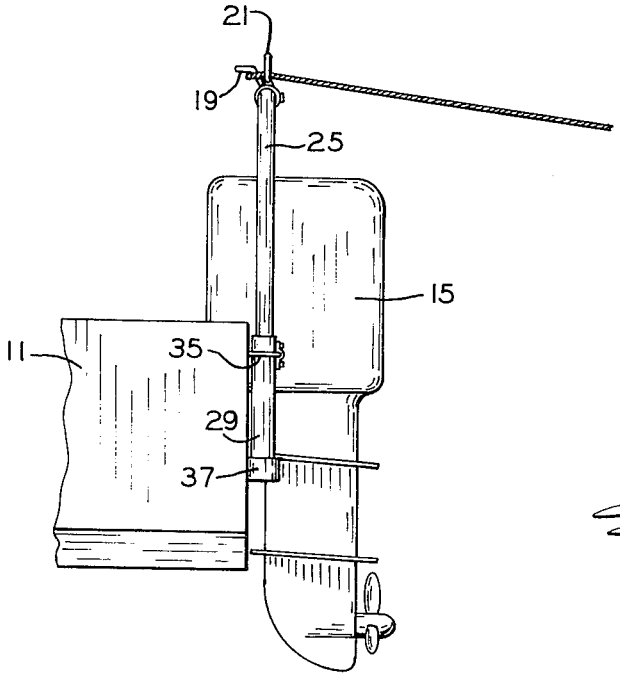
FIG. 2 is a partial view of the port side of the boat and accessory of FIG. 1.

Considering first FIGS. 1 and 2, a power boat 11 has a transom or stern wall 13 on which is mounted a standard outboard motor 15 according to any of the known techniques. A tow rope attachment point 17 is centrally located above the motor and may comprise a stud 19 and a ring 21 attached, for example, by welding to a sleeve 23. The sleeve 23 is horizontally disposed above the motor and supported in that location by a pair of L-shaped structures 25 and 27 which in turn telescopingly engage two additional tubular members 29 and 31 with the entire accessory being attached to the transom by a pair of U-bolts 33 and 35 which, as will appear more clearly subsequently, provide both an attaching and adjusting aspect to the present invention. A pair of guards, such as rubber bumpers 37 and 39, prevent the attachment from marring the transom.

Figure 3:
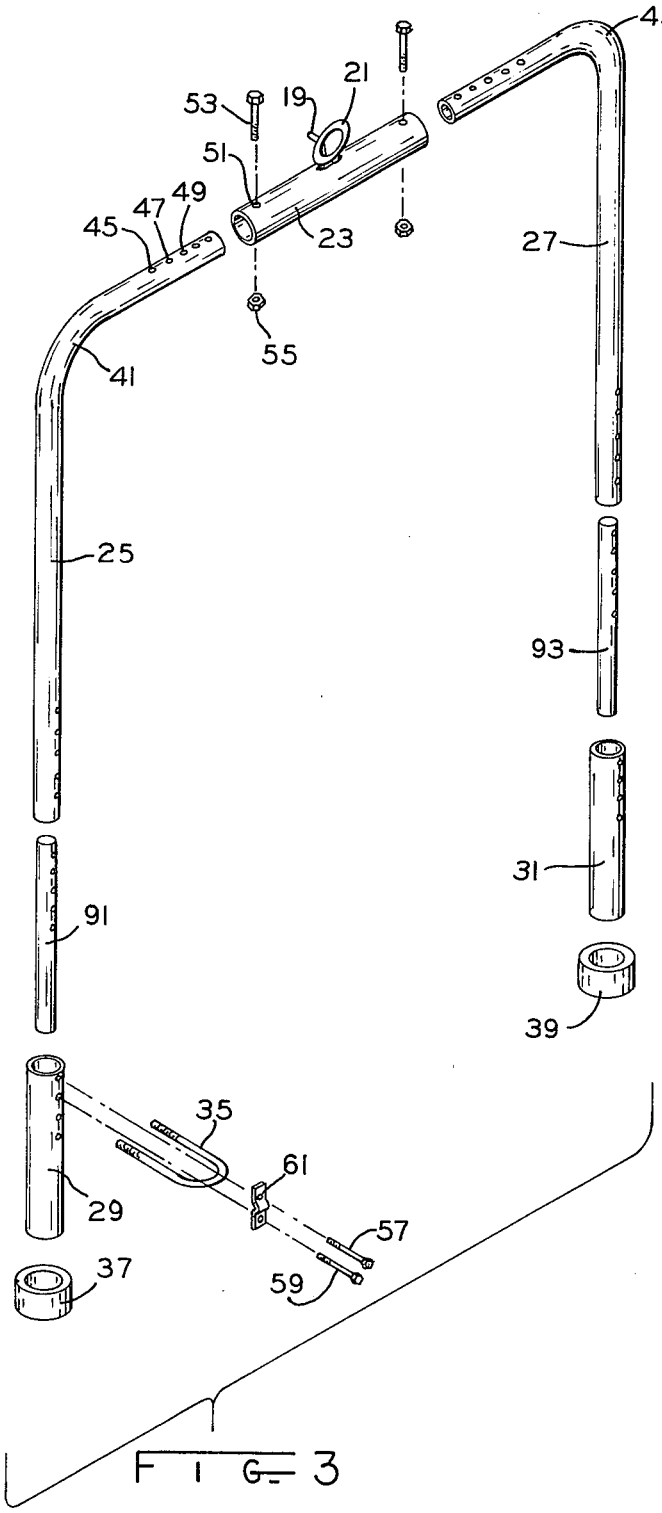
FIG. 3 is an exploded perspective view of the accessory of FIG. 1.

Considering now FIG. 3, the accessory of the present invention comprises a plurality of telescopingly engaged tubular members 29, 25, 23, 27 and 31 having at least a pair of elbow portions or bends 41 and 43 in the L-shaped tubular members with the tubular members being provided with a plurality of alignable apertures such as 45, 47, 49 and 51 which apertures lie in the vicinity of the telescoping overlap of a pair of tubular members. Clearly, each tubular member may be provided with plural apertures or one of the members may be provided with but a single aperture and the other provided with a plurality of apertures as desired.

The accessory is assembled by telescopingly engaging, for example, the tubular members 41 and 43 to the degree desired to give the appropriate separation between the downwardly extending portions of the U-shaped accessory and fastened by passing a bolt such as 53 through the apertures 51 and the appropriate aperture of the pertaining tubular member 41 and affixing that bolt 53 in position, for example, by a locking nut 55. The L-shaped member 27 is similarly attached to sleeve 23 and the tubular members 29 and 31 telescopingly meshed with the two downwardly extending portions of the U-shaped structure and fastened thereto at a preferred length and the accessory mounted to the boat transom as will appear more clearly in discussing FIGS. 4, 5, and 6.

Figure 4:
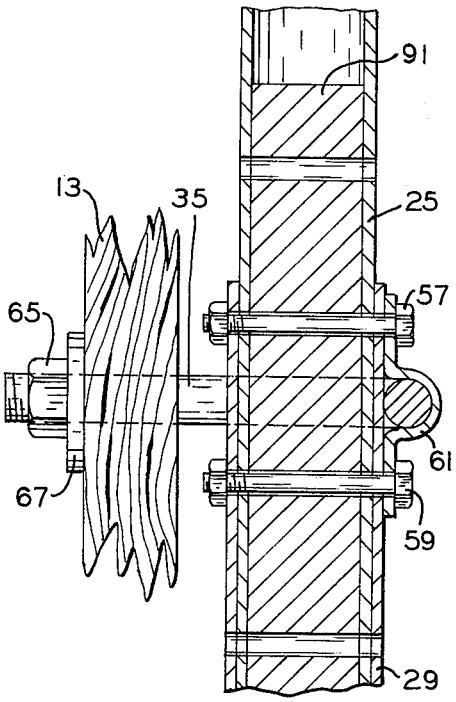
FIG. 4 is a verticle sectional view illustrating one scheme for attaching the accessory to a boat.

In each instance the accessory is attached to the transom by a pair of U-bolts and since the pull on the tow rope attachment means is always away from the boat, the two bumpers 37 and 39 rest against the transom. As illustrated in FIGS. 3 and 4, the U-bolt passes around tubular member 29 in the vicinity of one of the telescoping overlaps and through the transom and a pair of bolts 57 and 59 function to secure the two tubular members together to provide the desired height of the attachment point over the motor and, also, by way of a clip 61 function to hold the U-bolt 35 in place during the attachment process. This is also depicted in FIG. 4 where the U-bolt 35 passes around the pertaining telescoping tubular members 25 and 29 in the vicinity of the overlapping portion and through the transom 13 to be secured thereto by nuts such as 65 and washers or a reinforcing plate such as 67.

Figure 5:
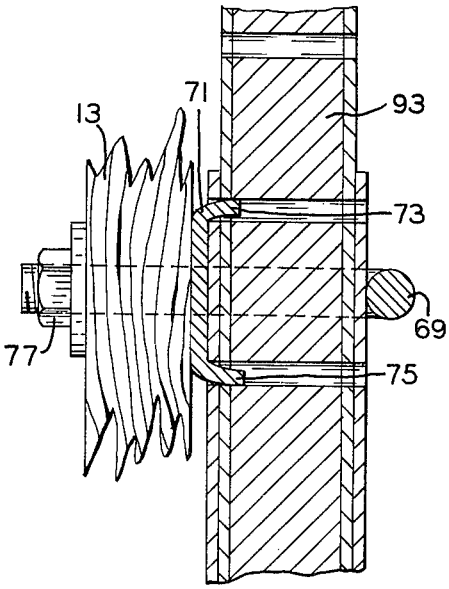
FIG. 5 is a verticle sectional view illustrating another scheme for attaching the accessory to a boat.

In FIG. 5 U-bolt 69 passes around the tubular members and through transom 13 as before, however, clip 61 and bolts 57 and 59 have been deleted and their function of locking tubes together for the preferred height it now performed by a plate 71. The plate 71 may be a flat plate having a pair of U-bolt passing apertures therein and one or more protrusions such as 73 and 75 which are deformed out of the plane of the plate 71 so as to pass through selected pairs of alignable apertures in the two tubular members thereby holding those tubular members at a preferred relative position once the U-bolt nuts such as 77 are tightened to both affix the accessory to the boat and to lock the tubular members in a preferred position.

Figure 6:
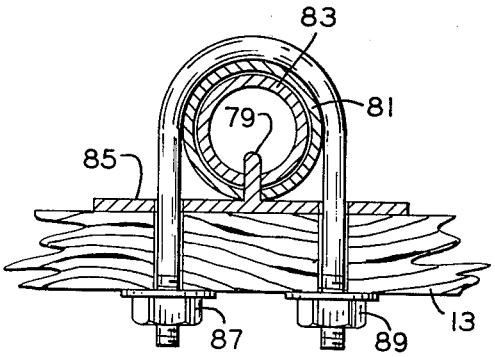
FIG. 6 is a horizontal sectional view illustrating yet another scheme for attaching the accessory to a boat.

FIG. 6 illustrates a top sectional view of a variation on the idea of FIG. 5 where but a single protrusion 79 passes through selected aperture in the pair of tubular members 81 and 83 with this protrusion 79 extending from the plate 85 which again has a pair of U-bolt passing apertures to allow tightening of the nuts 87 and 89 to both clamp the accessory to the transom 13 and to force the protrusion 79 into a pair of alignable apertures in the tubes thereby holding the accessory to the boat with the tow rope attachment point at a preferred elevation above the stern. Thus, once in place the protrusions such as 73, 75, or 79 function to prevent relative axial movement of the pertaining engaged tubular members while the associated U-bolts function to attach the accessory to the boat stern wall.

From the foregoing it is clearly seen that the present invention provides a relatively high easy release tow rope attachment point above the general level of a boat stern in an adjustable manner to accommodate a wide variety of boat and outboard motor configurations. While the invention has been described with respect to a specific preferred embodiment, numerous modifications will suggest themselves to those of ordinary skill in the art. For example, in FIG. 3 an additional pair of tubular members 91 and 93 having correspondingly alignable apertures in the side walls thereof may telescopingly engage both of the tubular portions of the downwardly extending part of the U-shaped member in the area where those tubular portions are fastened together to give additional rigidity to the joint between the tubular members. This, as well as numerous other modifications will readily suggest themselves to those of ordinary skill in the art and accordingly the scope of the present invention is to be measured only by that of the appended claims.

I claim:

1. An accessory for attachment to a power boat for providing a relatively high, easy release tow rope attachment point above the general level of the boat stern comprising:

a sleeve;

a ring, and a stud adjacent the ring whereby a tow rope bight may be passed through the ring and over the stud with the ring preventing inadvertent detachment of the tow rope from the stud, the ring and stud being connected to the sleeve;

a pair of generally L-shaped structures each telescopingly engaging the sleeve from opposite ends thereof;

a pair of tubular members telescopingly engaging the respective ends of the L-shaped members remote from the sleeve, the tubular members and L-shaped structures having alignable apertures in the vicinity of their respective telescoping engagement;

a pair of means for locking the respective L-shaped structures and tubular members together each including at least one protrusion for extending through the aligned apertures; and means for simultaneously securing the accessory to a boat and retaining the protrusion in position through the aligned apertures.

2. An accessory for attachment to the transom of a power boat for providing a relatively high easy release tow rope attachment point above the general level of the boat stern comprising a plurality of telescopingly engaged tubular members having at least a pair of elbow portions with tow rope attachment means located on a tubular member between the elbow portions, and means associated with adjacent pairs of telescoping tubular members for fastening those pairs together, at least two of the means for fastening being adapted to provide the further function of fastening the accessory to the boat transom, the telescopingly engaged tubular members being provided with a plurality of alignable apertures in the vicinity of telescoping overlap, the said at least two means for fastening each comprising a U-bolt adapted to pass around a tubular member in the vicinity of the overlap and through the transom, and a plate having a pair of U-bolt passing apertures and at least one protrusion, the plate adapted to lie between the transom and the pertaining tubular member with the protrusion passing through a pair of alignable apertures to prevent relative axial movement of the pertaining engaged tubular members.

3. The accessory of claim 2 wherein the tow rope attachment means comprises a ring and a stud adjacent the ring whereby a tow rope bight may be passed through the ring and over the stud with the ring preventing inadvertent detachment of the tow rope from the stud.

4. The accessory of claim 3 wherein the tubular members form an inverted U-shape with the tubular member between the elbow portions being disposed horizontally above the boat stern and supported between downwardly extending portions of the U.

* * * * *